US006318276B1

(12) United States Patent
Reinecke

(10) Patent No.: US 6,318,276 B1
(45) Date of Patent: Nov. 20, 2001

(54) TABLE UNIT

(75) Inventor: Harry Reinecke, Nürtingen (DE)

(73) Assignee: Dauphin Entwicklungs-U. Beteilingungs-GmbH, Neukirchen (DE)

( * ) Notice: Subject to any disclaimer, the term of this patent is extended or adjusted under 35 U.S.C. 154(b) by 0 days.

(21) Appl. No.: 09/662,586

(22) Filed: Sep. 15, 2000

(30) Foreign Application Priority Data

Sep. 18, 1999 (DE) ..... 299 16 465 U

(51) Int. Cl.[7] ..... A47B 13/00

(52) U.S. Cl. ..... 108/159.11; 108/158.13; 248/222.13

(58) Field of Search ..... 108/155, 156, 108/157.16, 158.12, 158.13, 159.11, 64; 248/221.12, 222.13, 223.21

(56) References Cited

U.S. PATENT DOCUMENTS 1,520,517 * 12/1924 Thomason ..... 108/155
3,339,503 * 9/1967 Flodell ..... 108/64
4,725,029 * 2/1988 Herve ..... 248/221.12
5,232,303 8/1993 Rubner .
5,549,055 * 8/1996 Kusch ..... 108/159.11

FOREIGN PATENT DOCUMENTS 22 18 094 A 10/1973 (DE) .
29822475 U1 12/1998 (DE) .
0 753 672 A 1/1997 (EP) .
000458042-A * 11/1991 (EP) ..... 108/154

* cited by examiner

*Primary Examiner*—Peter M. Cuomo
*Assistant Examiner*—Jerry A. Anderson
(74) *Attorney, Agent, or Firm*—Browdy and Neimark

(57) ABSTRACT

A table unit, in which table tops with pedestals can be joined to, and detached from, each other easily and without the need of tools, comprises at least one table top, which has at least one locking slot provided thereon; and at least one pedestal supporting the at least one table top, the pedestal having at least one locking bolt, which is movable into engagement with the at least one locking slot for connection of both, and an arresting device to be operated without tools for arresting the at least one locking bolt in the at least one locking slot.

14 Claims, 4 Drawing Sheets

TABLE UNIT

BACKGROUND OF THE INVENTION

1. Field of the Invention

The invention relates to a table unit.

2. Background Art

From DE 298 22 475 U1 a table unit comprising several table tops is known, which are connectable in series. An arresting device for connecting the table tops is provided, which comprises an arresting hook which can be,brought into engagement with an arresting slit. A disadvantage of this known table unit is that the connecting mechanism does not work efficiently.

SUMMARY OF THE INVENTION

It is an object of the invention to embody a table unit in which table tops with pedestals can be joined to, and detached from, each other easily and without the need of tools. This object is attained in a table unit comprising at least one table top, which has at least one locking slot provided thereon; and at least one pedestal supporting the at least one table top, the pedestal having at least one locking bolt, which is movable into engagement with the at least one locking slot for connection of both, and an arresting device to be operated without tools for arresting the at least one locking bolt in the at least one locking slot. The gist of the invention resides in that, alternatively, a table top can be connected to two pedestals, forming an individual table, or several table tops can be joined to each other with pedestals disposed in between, forming a chain of tables.

Additional features and details of the invention will become apparent from the description of an exemplary embodiment, taken in conjunction with the drawing.

DESCRIPTION OF THE PREFERRED EMBODIMENT

Figure 1:
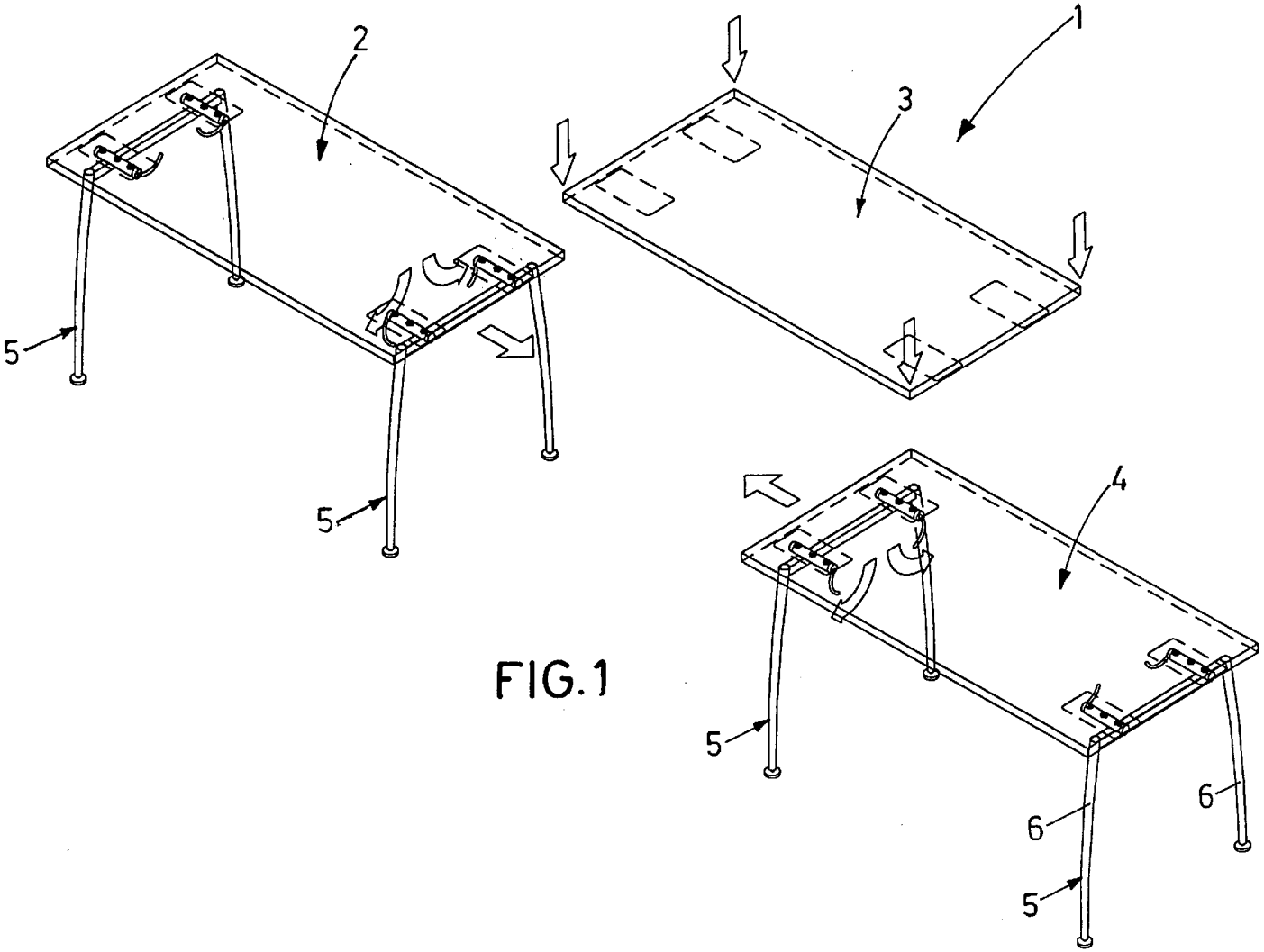
FIG. 1 is a plan view of a table unit with table tops and pedestals.
Figure 2:
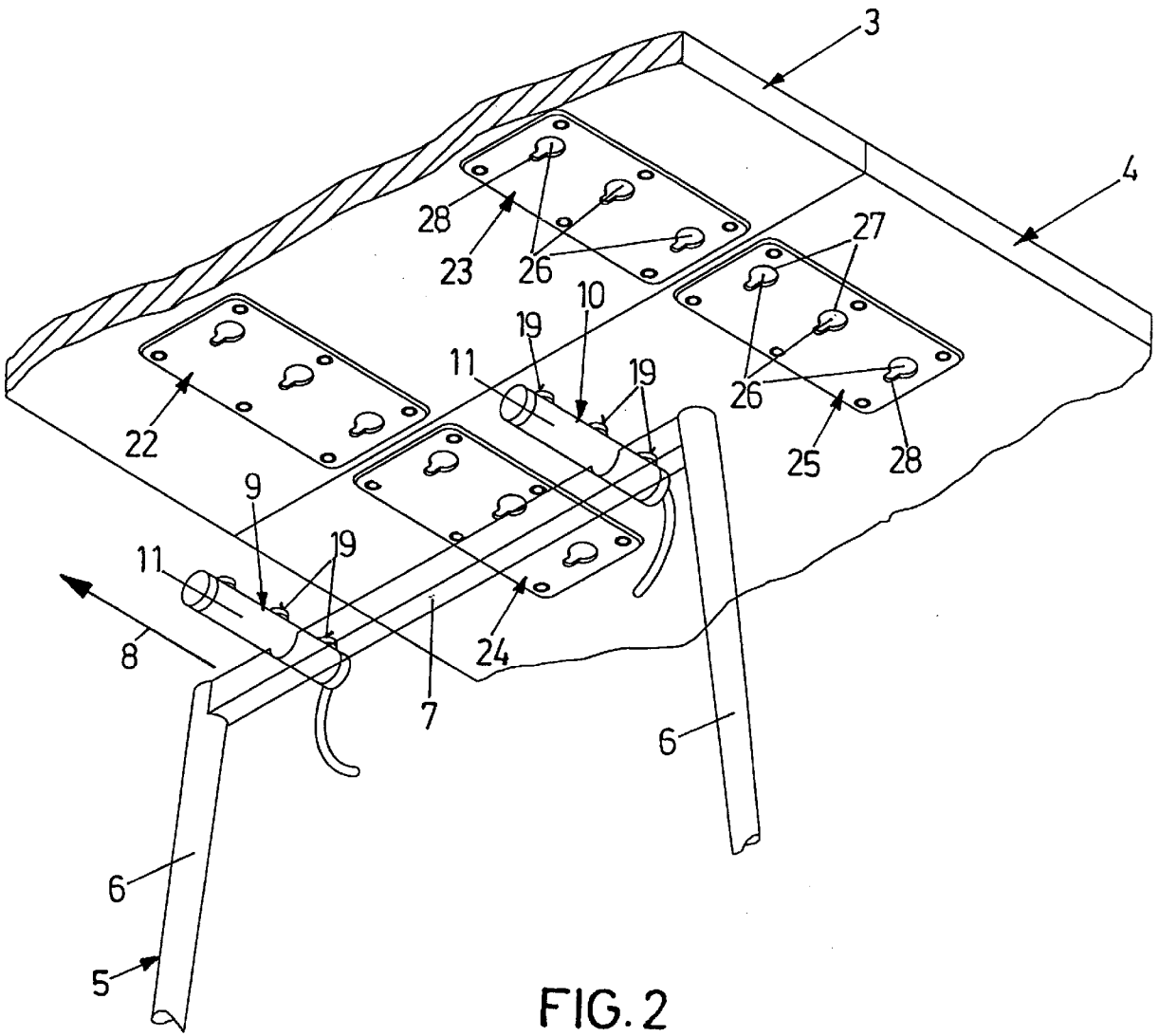
FIG. 2 is a detail, on an enlarged scale, of a pedestals with two table tops.
Figure 4:
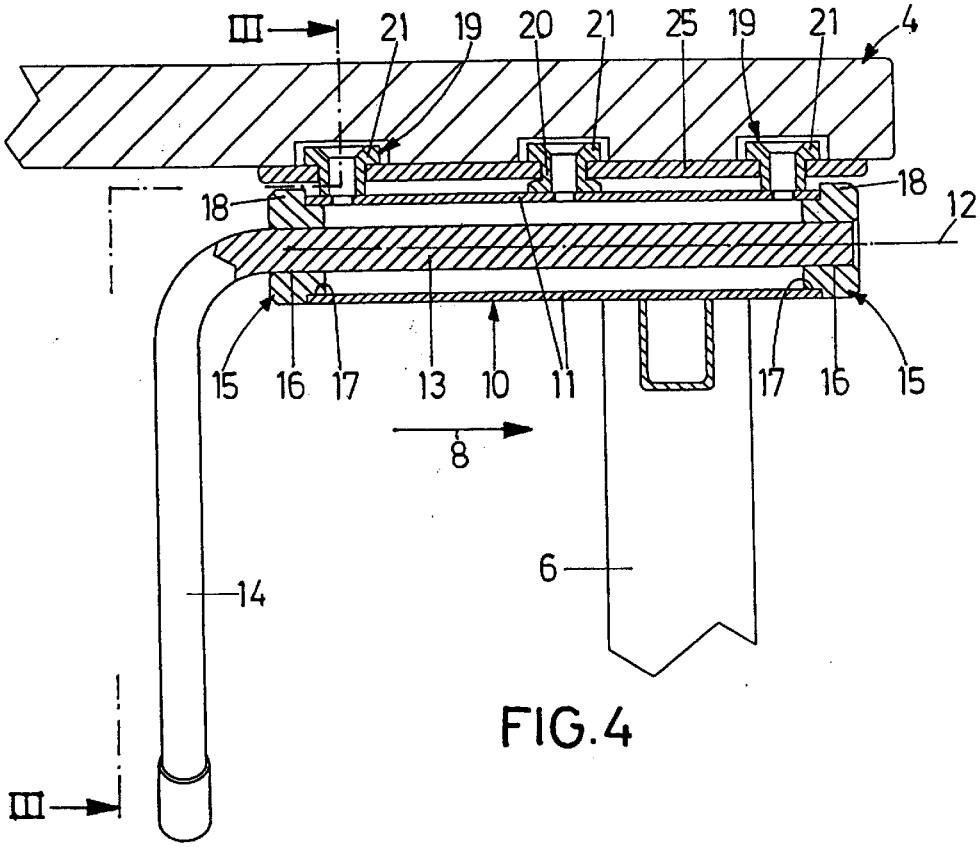
FIG. 4 is a sectional view on the line IV—IV in FIG. 3.
Figure 6:
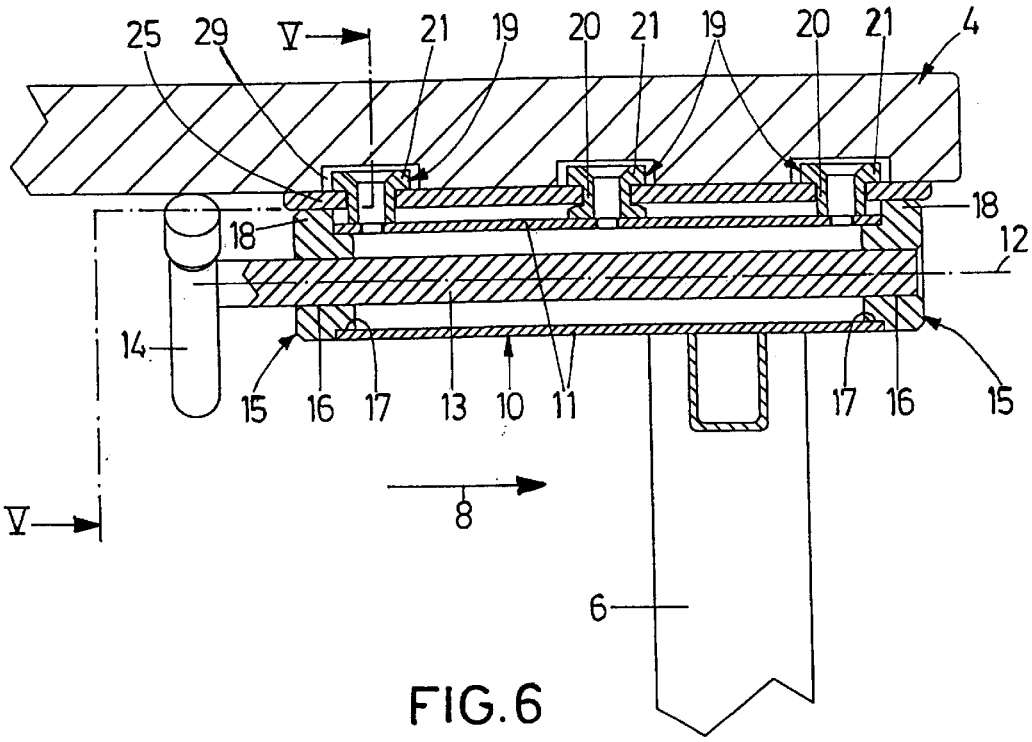
FIG. 6 is a sectional view on the line VI—VI in FIG. 5.

As seen in FIG. 1, the table unit 1 comprises several table tops 2, 3 and 4, which are connectable in series. The table tops 2 and 4 are supported on pedestals 5 which are joined to the table tops 2, 3 at the frontal ends thereof. By way of the pedestals 5 of the table tops 2 and 4, the table top 3 is supportable there-between and connectable thereto, The pedestal 5 has two standing legs 6, which are united at their upper ends by a supporting beam 7, as a result of which the pedestal 5 takes the shape of a downwardly open U. Provided on the beam 7 are two transverse beams 9, 10 which are substantially perpendicular to the lengthwise extension of the beam 7 and parallel to a longitudinal direction 8. The transverse beams 9, 10 have a tubular housing 11, the central longitudinal axis 12 of which is parallel to the longitudinal direction 8. A shaft 13 is disposed in the housing 11; it is pivotal about the central longitudinal axis 12 and, at an end seen on the left in FIGS. 4 and 6, it is equipped with an operating lever 14, forming a single piece therewith. A cam disk 15 is provided on each of the ends of the housing 11, centrally comprising a hole 16 for the accommodation of the shaft 13. The cam disks 15 are tightly connected to the shaft 13. On the side turned toward the inside of the housing 11, the cam disk 15 has an annular groove 17 with which engages the respective lengthwise end of the housing 11. The unit consisting of the shaft 13 and the cam disks 15 is mounted in the housing 11 pivotally about the central longitudinal axis 12 and forms an arresting device. In the portion turned away from the housing 11, the cam disks 15 have a cam section 18 which projects lengthwise beyond the housing 11 and the outer circumference of which does not exhibit a constant radius relative to the central longitudinal axis 12 and stands out from the housing 11 at least partially in the radial direction. In a cross section, the cam section 18 has an oval shape or the shape of an eccentric circular disk. On the upper side of the transverse beams 9 and 10, respectively, three locking bolts 19 are provided, which are spaced apart equally in the longitudinal direction 8 and are mushroom-shaped in the way of a bolt head. The locking bolts 19 have a neck 20 joined to the housing 11 and a head 21 which forms one piece therewith and stands out from the neck 20. The head 21 and neck 20 can be solid. They may also be a plastic sleeve which is riveted on the housing 11 by a longitudinal rivet.

In the vicinity of their two frontal ends, the table tops 3 and 4 comprise locking plates 22, 23 and 24, 25, respectively, which are parallel to each other. They are united with the table tops 3, 4 and comprise recesses 26—also designates as locking slots—which are displaced relative to each other in the longitudinal direction 8 by the same distance from each other as the locking bolts 19. These recesses 26 have the shape of a keyhole, consisting of a circular opening 27 and an adjoining oblong hole 28. The oblong holes 28 of the locking plates 22, 23, 24 and 25 are unidirectional and perpendicular to the longitudinal direction 8. Provided on the side of the recesses 26 that is turned towards the respective table top 3 and 4 is a rear recess 29 of sufficient depth to accommodate the respective locking bolts 19.

Figure 3:
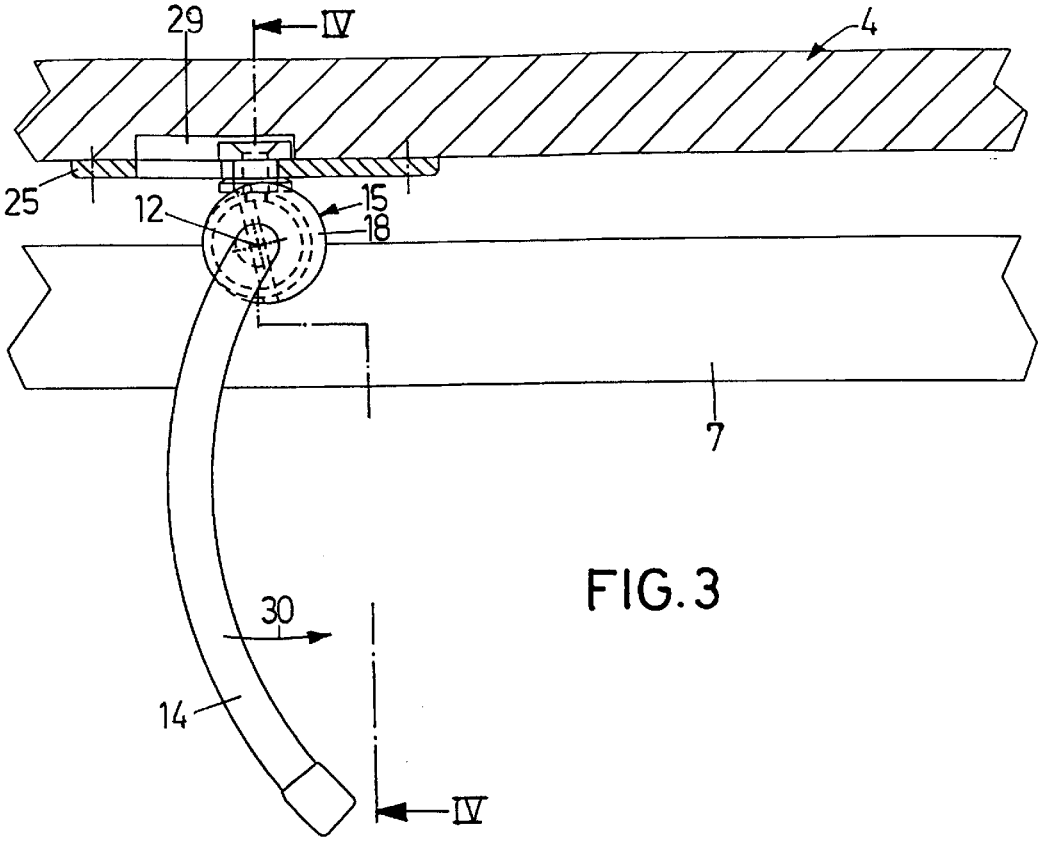
FIG. 3 is a cross sectional view through a table unit in the position of assembly.
Figure 5:
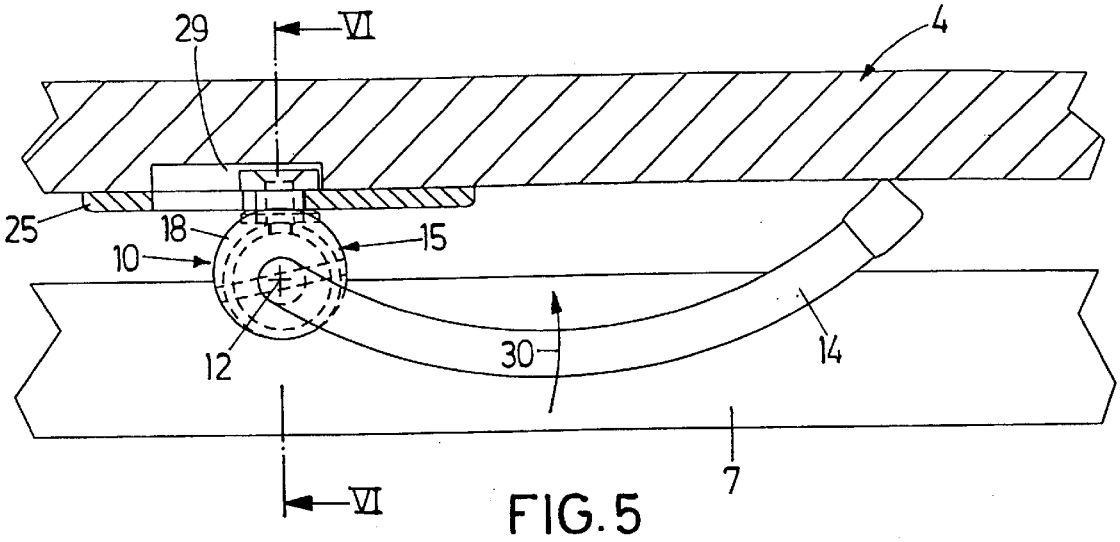
FIG. 5 is an illustration according to FIG. 3 in the stop postion.

The following is a description of the assembly of two pedestals 5 and the table top 4. This helps create an ordinary individual table with a table top 4 and two pedestals 5 disposed at the ends thereof, which is designated as a table unit 1. The three locking bolts 19 of the transverse beams 9 and 10 are pushed through the openings 27 of the locking plates 24 and 25. Then the pedestal 5 is moved in the direction of the oblong holes 28 for the heads 21 to move into engagement with the surrounding of the oblong holes 28. In this position, the table top 4 can no longer be pulled upwards off the locking bolt 19. For arresting, the operating lever 14 is pivoted out of the position of assembly seen in FIG. 3 into the stop position illustrated in FIG. 5.

As a result, the cam section 18 of the cam disk 15 stops on the locking plate 24 and 25, whereby the neck 20 is forced against the respective plate 24 and 25 and the pedestal 5 and the table top 4 are clamped together. The position of the cam section 18 is selected such that in the stop position, the portion of greatest radial distance from the axis 12 lies beyond the area of contact between the cam disk 15 and the locking plate 25 in the direction of pivoting 30. As a result, the stop position is self-arresting and the operating lever 14 cannot disengage by itself in the stop position. For removal of the pedestal 5, the respective operating levers 14 are pivoted out of the stop position into the position of assembly counter to the direction of pivoting 30, whereby the connection between the locking bolt 19 and the locking plate 24 and 25 is released and displacement of the pedestal 5 in the direction toward the openings 27 and subsequent removal of the table top 4 is possible.

The following is a description of how two adjoining table tops 3 and 4 can be united with a pedestal 5. To this end, two of the three locking bolts 19 are led into the recesses 26 turned towards the end of the table top 4. The third locking bolt 19, which is disposed at the end of the transverse beam 9 and 10 in the longitudinal direction 8, projects beyond the free end of the table top 4. The recesses 26 disposed at each of the ends of the locking plates 22 and 23 are moved into engagement with the above-mentioned locking bolt 19. Then the pedestal 5 is displaced in the direction of the oblong holes 28 and the operating lever 14 is pivoted out of the position of assembly into the stop position. The table tops 3 and 4 are now united with a joint pedestal 5. In this way it is possible to produce long chains of tables which can easily be assembled and disassembled. Moreover, pedestals can be omitted in the case of long tables.

What is claimed is:

1. A table unit (1) comprising a) at least one table top (2, 3, 4), which has
 i) at least one locking slot provided thereon; and b) at least one pedestal (5) supporting the at least one table top (2, 3, 4), the pedestal having
 i) at least one locking bolt (19), which is movable into engagement with the at least one locking slot for connection of both, and
 ii) an arresting device to be operated without tools for arresting the at least one locking bolt (19) in the at least one locking slot, wherein the at least one locking slot is provided in a locking plate (22, 23, 24, 25), which is joined to the at least one table top (2, 3, 4);

the arresting device comprises a shaft (13) and at least one eccentric cam disk (15), which is joined thereto and is pivotal from a position of assembly, in which the at least one locking bolt (19) is not in arresting engagement with the at least one locking slot, into a stop position, in which the at least one locking bolt (19) is in arresting engagement with the at least one locking slot;

said table unit further comprises an operating lever (14) coupled to the shaft (13) for pivoting the shaft; and the at least one cam disk (15) is supported relative to the locking plate (22, 23, 24, 25).

2. A table unit (1) according to claim 1, wherein the shaft (13) is lodged in a housing (11) that is joined to the pedestal (5), the at least one locking bolt (19) being joined to the housing (11).

3. A table unit (1) according to claim 1, wherein the at least one locking slot has the shape of a keyhole.

4. A table unit (1) according to claim 1, wherein the locking bolt (19) has a neck (20) and a head (21) joined thereto and standing out therefrom.

5. A table unit (1) according to claim 1, wherein a first table top (4) is provided with a first locking slot and a second table top (3) is provided with a second locking slot, and wherein at least one pedestal (5) is provided, having a first locking bolt (19) and a second locking bolt (19), the first locking bolt (19) being movable into engagement with the first locking slot and the second locking bolt (19) being movable into engagement with the second locking slot.

6. A table unit (1) according to claim 9, wherein the engagement of the first locking bolt (19) with the first locking slot and the engagement of the second locking bolt (19) with the second locking slot is arrested by actuation of an arresting device.

7. A table unit according to claim 1, wherein:

said cam disk is pivotable with said shaft about an axis;

said cam disk has a cam section that contacts an area of contact of said locking plate when said cam disk is in the stop position;

said cam section has an outer surface having a varying radius relative to the axis and has a portion that is at a greatest radial distance from the axis; and said outer surface portion that is at a greatest radial distance from the axis is located such that when said cam disc is pivoted from said position of assembly to said stop position, said outer surface portion that is at a greatest radial distance from the axis moves past the area of contact of said locking plate.

8. A table unit (1) comprising a) at least one table top (2, 3, 4), which has
 i) at least one locking slot provided thereon; and b) at least one pedestal (5) supporting the at least one table top (2, 3, 4), the pedestal having
 i) at least one locking bolt (19), which is movable into engagement with the at least one locking slot for connection of both, and
 ii) an arresting device to be operated without tools for arresting the at least one locking bolt (19) in the at least one locking slot, wherein the at least one locking slot is provided in a locking plate (22, 23, 24, 25), which is joined to the at least one table top (2, 3, 4);

the arresting device comprises a shaft (13) and at least one eccentric cam disk (15), which is joined thereto and is pivotal from a position of assembly, in which the at least one locking bolt (19) is not in arresting engagement with the at least one locking slot, into a stop position, in which the at least one locking bolt (19) is in arresting engagement with the at least one locking slot; and the shaft (13) is lodged in a housing (11) that is joined to the pedestal (5), the at least one locking bolt (19) being joined to the housing (11).

9. A table unit (1) according to claim 8, wherein a first table top (4) is provided with a first locking slot and a second table top (3) is provided with a second locking slot, and wherein at least one pedestal (5) is provided, having a first locking bolt (19) and a second locking bolt (19), the first locking bolt (19) being movable into engagement with the first locking slot and the second locking bolt (19) being movable into engagement with the second locking slot.

10. A table unit (1) according to claim 9, wherein the engagement of the first locking bolt (19) with the first locking slot and the engagement of the second locking bolt (19) with the second locking slot is arrested by actuation of an arresting device.

11. A table unit (1) according to claim 8, wherein the at least one cam disk (15) is supported relative to the locking plate (22, 23, 24, 25).

12. A table unit (1) according to claim 8, wherein the at least one locking slot has the shape of a keyhole.

13. A table unit (1) according to claim 8, wherein the locking bolt (19) has a neck (20) and a head (21) joined thereto and standing out therefrom.

14. A table unit (1) according to claim 8, wherein the shaft (13) is pivotal by 5 an operating lever (14).

* * * * *